US005720636A

United States Patent [19]

Burg

[11] Patent Number: 5,720,636

[45] Date of Patent: Feb. 24, 1998

[54] MARINE PROPULSOR

[76] Inventor: Donald E. Burg, 15840 S.W. 84 Ave., Miami, Fla. 33157

[21] Appl. No.: 628,049

[22] Filed: Apr. 8, 1996

Related U.S. Application Data

[63] Continuation-in-part of Ser. No. 486,305, Feb. 28, 1990, abandoned, Ser. No. 604,741, Oct. 26, 1990, abandoned, Ser. No. 848,252, Mar. 9, 1992, abandoned, Ser. No. 118,029, Sep. 8, 1993, abandoned, and Ser. No. 309,758, Sep. 21, 1994, Pat. No. 5,505,639.

[51] Int. Cl.[6] ..... B63H 11/103; B63H 11/11; B63H 11/113; B63H 11/117

[52] U.S. Cl. ..... 440/41; 440/42; 440/43; 440/47

[58] Field of Search ..... 440/41–43, 46, 440/47, 44, 45, 71, 66, 67, 68, 69, 70

[56] References Cited

U.S. PATENT DOCUMENTS

| | | | |
|---|---|---|---|
| 3,785,327 | 1/1974 | Smith | 60/221 |
| 3,788,265 | 1/1974 | Moore | 440/41 |
| 3,805,731 | 4/1974 | Furst et al. | 440/47 |
| 3,943,876 | 3/1976 | Kiekhaefer | 440/42 |
| 3,985,094 | 10/1976 | Stricker | 440/47 |
| 4,371,350 | 2/1983 | Kruppa et al. | 440/69 |
| 4,917,637 | 4/1990 | Soga et al. | 440/43 |
| 4,929,200 | 5/1990 | Guezou et al. | 440/38 |
| 4,941,423 | 7/1990 | Van Tassel | 440/69 |
| 5,350,325 | 9/1994 | Nanami | 440/41 |
| 5,505,639 | 4/1996 | Burg | 440/42 |

FOREIGN PATENT DOCUMENTS

| | | | |
|---|---|---|---|
| 2217171 | 10/1973 | Germany . | |
| 406001291 A | 1/1994 | Japan | 440/41 |
| 88/05008 | 7/1988 | WIPO . | |

*Primary Examiner*—Sherman Basinger
*Attorney, Agent, or Firm*—Robert J. Van Der Wall

[57] ABSTRACT

The instant invention describes an advanced marine propulsor that has a rotor that is, at least in its majority, enclosed by structure where the rotor, in its preferred embodiment, receives water over at least a majority of its lower portions and gas over at least part of its upper portions. It is possible to delete the gas flow by use of a valve or structure so that an approximate doubling of water flow rate occurs which is valuable as a thrust enhancer for low and mid-range marine vehicle speed operation. It is also possible to operate the rotor with water directed mainly to its lower portions but with little or no gas directed to its upper portions thus forming a partial vacuum over the upper portions of the rotor vanes. When used, a water directing valve that directs water to the rotor vanes preferably has a curvilinear water contacting surface so that water will adhere to and follow that surface. The inherent structural strength of the rotor can be increased by a rotor ring that can be inset into a recess in the adjacent housing to minimize drag of the rotor ring. A simple steering and reversing system for marine propulsors is also proposed. It includes a steering rudder that is in mechanical communication with reversing guide vanes or nozzles such that movement of the steering rudder causes a common movement of the reversing guide vanes or nozzles. A reversing gate is used to block discharge flow when in reverse and thereby redirect the discharge flow to the reversing guide vanes or nozzles. A water deflecting flap is optionally provided to deflect water from hitting the reversing guide vanes or nozzles when operating in a high speed ahead mode and whereby this water deflecting flap is rotated out of the way by force of the discharging water when in reverse.

39 Claims, 3 Drawing Sheets

Figure 7
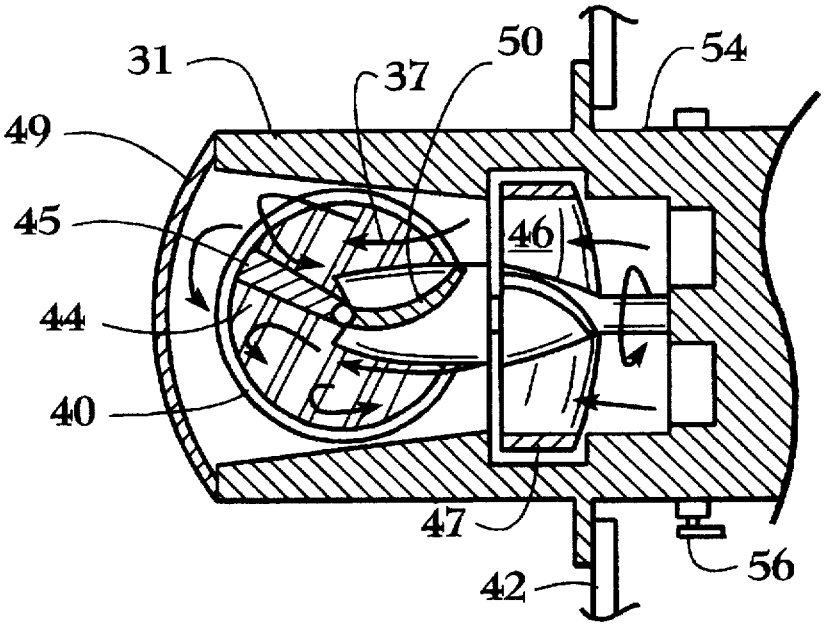
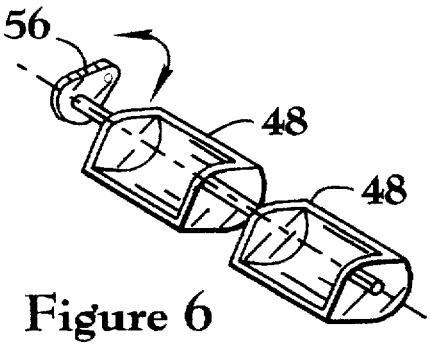
Figure 6
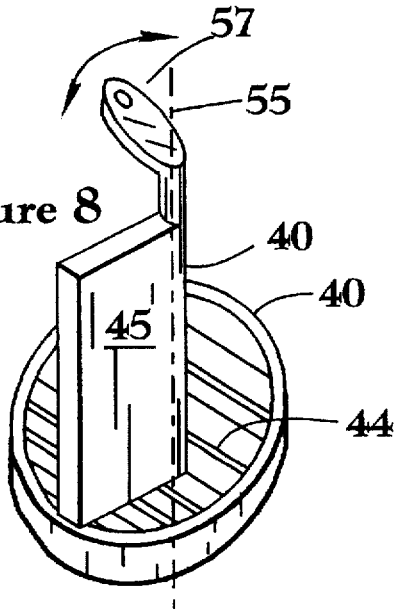
Figure 8
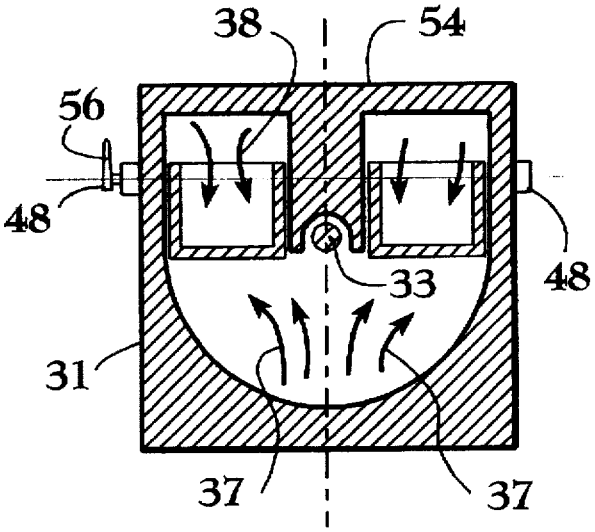
Figure 9

MARINE PROPULSOR

CROSS REFERENCE TO OTHER APPLICATIONS

This application is a continuation-in-part to Applicant's earlier applications, Ser. No. 486,305 filed Feb. 28, 1990, now abandoned, Ser. No. 604,741 filed Oct. 26, 1990, now abandoned, Ser. No. 848,252 filed Mar. 9, 1992, now abandoned; Ser. No. 922,574 filed Jul. 30, 1992, now abandoned; Ser. No. 118,029 filed Sep. 8, 1993, now abandoned; and Ser. No. 309,758 filed Sep. 21, 1994, now U.S. Pat. No. 5,505,639 issued Apr. 9, 1996.

BACKGROUND OF THE INVENTION

Enclosed rotor waterjet propulsors are gaining more acceptance yearly in the form of small 50–150 HP units for personnel watercraft and in mid-size 1,000–7,000 HP units for patrol craft, high speed passenger ferries, and some motor yachts. Even though grossly inefficient in small sizes, they are necessary for personnel watercraft from a safety standpoint when compared to exposed propellers. The mid-size units are mainly applied to vessels such as high speed passenger ferries that spend most of their time cruising at high speeds where the waterjets are relatively efficient. These waterjets are noted to be inefficient at low and mid-range speeds and they have speed and power operational limits imposed to reduce cavitation damage to their rotors. However, due to their benefits of shallow draft, low underwater noise signature, reduced maintenance compared to exposed propeller, shaft, and rudder propeller systems, more constant and smooth engine loadings, and reduced passenger cabin noise and vibration they are becoming a preferred selection for propulsion of high speed passenger ferries.

There are difficulties in applying waterjets to any air cushioned craft such as the Surface Effect Ship (SES) or Applicant's SEACOASTER air cushioned craft designs. That is because the air layer under air cushion craft is ingested into the waterjet's inlet and causes a severe degradation of waterjet performance. The reason for this deficiency is that the standard waterjet is a pressurized water system with a pressure building nozzle positioned downstream of the rotor or impeller. Even small amounts of air entrained or mixed in the water, five percent or less was a threshold noted in some tests, can cause a severe loss of impeller efficiency. Waterjet air ingestion problems are also evident on many standard planing hull craft when operating in rough water where the waterjet inlet can be broached.

Tests run by Pratt & Whitney Aircraft in 1967–1969 on a 3,200 horsepower waterjet demonstrated that the air ingestion problem existed and was severe with no easy solution. Tests on two of Applicant's waterjet propelled air cushioned passenger ferry designs, 350 passenger 38 knot 109 foot air cushioned vessels, at Avondale Industries, New Orleans, showed a severe degradation of performance when air ingestion into the twin 2,000 horsepower KaMeWa waterjets occurred. The inlets were modified on one of these vessels to drop down approximately 20 inches below the hull in a streamlined airfoil shape. This reduced but did not eliminate the air ingestion problem but at the cost of a very noticeable speed reduction. In summary, standard commercially available waterjet propulsors have severe limitations on performance imposed by cavitaion at low to mid-range speeds and rotor overspeed problems due to inlet air ingestion when operating at high speeds in rough seas. Further, their performance at low and mid-range speeds is generally considered to be poor. Applicant considers low speeds as 0 to 7 knots, mid-range speeds as 7 to 20 knots and high speeds as above 20 knots; however, for purposes of this application, high speed is defined as any marine vehicle speed of 15 knots or more.

Applicant's new marine propulsor, preferably called the Hydro-Air Drive or HAD offers a rotor that, in its optimum running condition, runs with only about the lower one half receiving water flow. It has, in its preferred embodiment, an open discharge with no flow restricting pressure building nozzle downstream of its rotor. It avoids cavitation and is immune to the air or gas ingestion problems that plague standard waterjets. It is also possible to cancel the gas flow to Applicant's rotor at low to mid-range speeds and thus double the mass flow in the preferred embodiment. This results in a much higher thrust at those low to mid-range speeds than that possible with the standard waterjet with its relatively small controlled flow discharge nozzle. For a more detailed discussion of the Hydro-Air Drive please refer to Applicant's U.S. Pat. No. 5,505,639.

A 22 inch diameter Hydro-Air Drive has been built and is now undergoing sea trials in a 40 foot V-hull boat. It is driven by a 400 horsepower Caterpillar diesel engine. Initial tests now underway at Ft. Lauderdale, Fla., indicate that mid-range thrust values are superior to commercial high speed waterjets. At speeds above 30 knots, performance also appears better than commercial waterjets. There are no signs of cavitation damage and no apparent operational difficulties due to inlet aeration even when operating at high speeds in rough seas. Further improvements to inlet and rotor design are now being implemented so final performance results are not available at this writing.

First tests were conducted with the flow directing structure stopping substantially forward of the rotor. This resulted in sheets of water spray, generated due to the close proximity of the inlet lip to the water surface, impacting the rotor above the shaft centerline. Water directing structure in the form of a plate that terminated proximal the horizontal centerline of the rotor and approximately one fourth of a rotor diameter forward of the rotor was then installed. Results were outstanding and a speed increase of approximately seven knots resulted. Based on these results, Applicant notes that there is a definite defining distance between the termination of the inlet liquid directing structure and the rotor vanes. While further tests remain to be made, Applicant defines this distance as no more than one and one half rotor diameters with less than one half rotor diameter preferred.

Applicant also notes that gas flow to an upper portion of the rotor gives good results and that ambient air and/or engine exhaust or other gas supply means can be used as the gas. However it is also possible to have inlet water flow directing structure terminate upstream and very close to the rotor and with no gas flow supplied to the upper portion of the rotor. In such instance the forward upper portion of the rotor vanes are essentially operating in a partial vacuum.

The use of an inlet valve assembly to direct liquid/gas flow to the rotor was presented in Applicant's issued U.S. Pat. No. 5,505,639; however, the instant invention adds refinements to that concept. It is noted that addition of a straight section as part of yet aft of the normally circular arc shaped valve mechanism improves accuracy of liquid flow to the rotor. It is also to be noted that such a flow directing structure can be used to direct inlet water only and that no gas flow need be supplied to the upper portion of the rotor. In such case, the upper portion of the rotor vanes would be operating in a partial vacuum at high marine vehicle speeds.

A new simple steering and reversing mechanism for marine propulsors such as waterjets and the instant invention that requires minimum actuation force is presented herein. This system uses a reverse steering guide vane assembly or nozzle positioned below the rotor discharge that is connected to and rotates at the same rate as a steering rudder. There is no reversing effect until a flow blocking discharge assembly or reversing bucket is lowered aft of the steering and reversing nozzle. This differs distinctly from German Patent 2217171 who offers a rudder that is independent of and separated from a set of 360 degree rotatable steering louvers. Flow blockage in the German Patent is accomplished by turning the steering rudder 90 degrees to the discharge flow thereby blocking the discharge from going rearward and redirecting it to the rotatable steering louvers. Both the rudder and the 360 degree rotatable steering louvers are independently driven which is not the case of the instant invention's simple substantially one piece unit that is driven by a common actuator. Since the instant invention's rudder, by working requirement, does not turn 90 degrees to the flow it does not require the high actuation forces of the referenced German Patent. Due to the aforementioned noteworthy distinctions there is little resemblance between the instant invention's steering and reversing mechanism and German Patent 2217171. Further, the instant invention offers an optional water deflecting mechanism, normally in the form of a flap like device, that can be positioned under its reversing guide vane assembly. This water deflecting mechanism keeps water from hitting the guide vanes during ahead operation and is simply pushed out of the way by the reversing discharge water flow during reverse operation.

SUMMARY OF THE INVENTION

With the foregoing in mind, it is the principal object of the preferred embodiment of the present invention to provide a simple new marine propulsor that has a rotor that is primarily enclosed by structure and said rotor, at least when propelling a marine vehicle at high speeds, operates with at least a majority of its lower portion in water and at least a part of its upper portion receiving gas and/or operating in a partial vacuum.

It is a further object of the instant invention to provide means to direct liquid flow to lower portions of said rotor vanes.

A related object of the invention is to provide gas flow to an upper portion of the rotor vanes.

It is another object of the invention to be able to shut off gas flow to the rotor vanes during low and/or mid range speed operation thereby increasing the amount of water flow during those operations.

It is a directly related object of the invention to provide a valve that is at least in part curvilinear to act to control the level of water to the rotor vanes.

It is another object of the invention that water supplied to the rotor is directed by structure, that can be fixed or movable, and that such structure can direct water to the rotor so precisely that no gas flow is required to an upper portion of the rotor vanes which would then be operating in a partial vacuum.

It is a further object of the invention that a stator vane or vanes can be positioned downstream of the rotor vanes to thereby straighten the discharge flow from the rotor vanes.

Another object of the invention is that a stator vane can be used forward of and in line with a steering rudder to thereby reduce the hydrodynamic drag of said steering rudder.

Another object of the invention is to provide a steering and reversing mechanism for marine propulsion systems whereby a steering rudder and reversing guide vanes or nozzles are commonly driven.

It is a directly related object of the invention that the steering rudder and the reversing guide vanes have a common rotational axis.

Another object of the invention is that the steering rudder can be truncated at it aft end to thereby cause a ventilation of said truncated end to reduce rudder drag.

It is yet another object of the invention that a reversing gate be implemented to block liquid flow from exiting aft and to thereby redirect said liquid flow to the reversing guide vanes.

It is yet another object of the invention to be able to shut off gas flow to the rotor vanes during reversing.

Still another object of the invention is that a movable, in relation to a marine propulsor, water flow deflecting means be provided to keep water from impacting the reversing guide vanes during ahead operation.

It is a directly related object of the invention that said water flow deflecting means is rotated or otherwise moved out of the way of reversing water flow by the force of the reversing water flow.

BRIEF DESCRIPTION OF THE DRAWINGS

FIG. 6 is an isometric projection view of the liquid flow directing valve. Note that the curvilinear valve member sections are made in two pieces and connected by a shaft here. The reason for this is that they straddle both sides of the drive shaft.

FIG. 7 is a top partial cross sectional view, as taken through line 7—7 of FIG. 2, that shows the reverse flow blocking means lowered to block flow rearward and thereby direct same to the reversing flow steering vanes or nozzle(s).

In this case, the reverse steering vanes are oriented for a reverse to starboard situation. Note that the rudder is oriented and turns commonly with the reverse steering vane means as can be seen here.

FIG. 8 is an isometric projection of the steering rudder and reverse steering vane means as shown as a common assembly here with a common drive shaft axis.

FIG. 9 is a cross sectional view, as taken through line 9—9 of FIG's 1 and 4 that shows the preferred rectangular housing shape forward of the rotor. The rectangular housing shape is the preferred embodiment in this location as it allows a wider more open design for the liquid flow directing valve.

DETAILED DESCRIPTION

Figure 1:
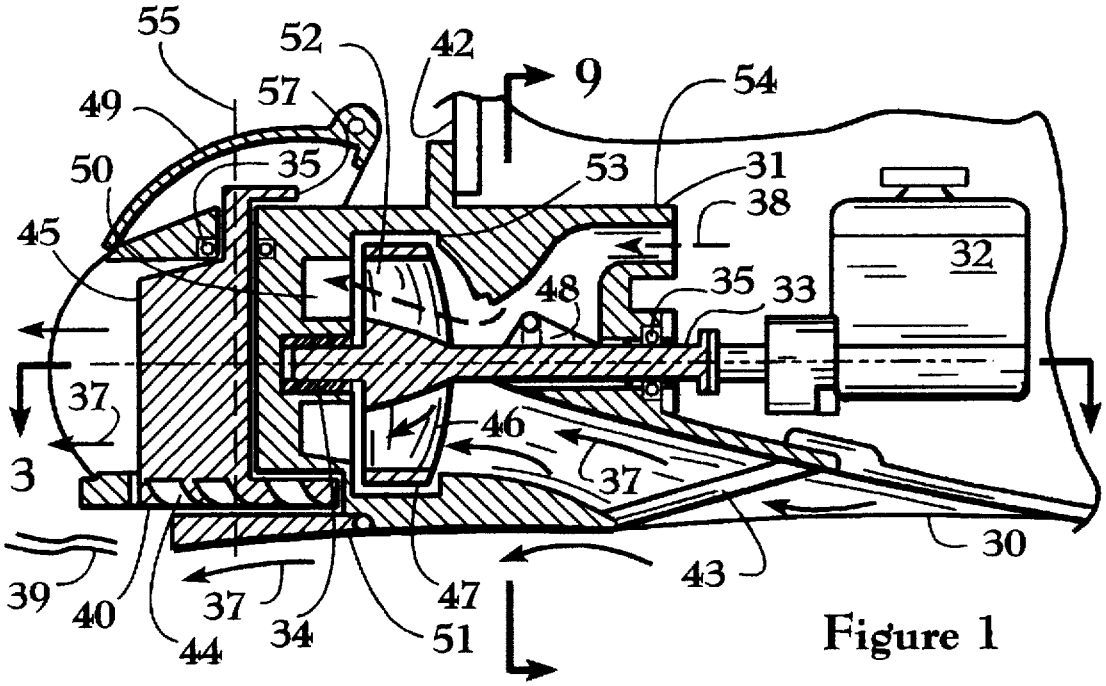
FIG. 1 presents a centerline cross sectional view, as taken through line 1—1 of FIG. 3, that shows the improved marine propulsor propelling a marine vehicle forward at high speed. Note the supplying of water to the lower portion of the rotor and gas to the upper portion. The level of water supplied to the rotor vanes can be controlled and the gas supply to the rotor can be substantially cut off by liquid flow directing means in the preferred embodiment of the instant invention.
Figure 3:
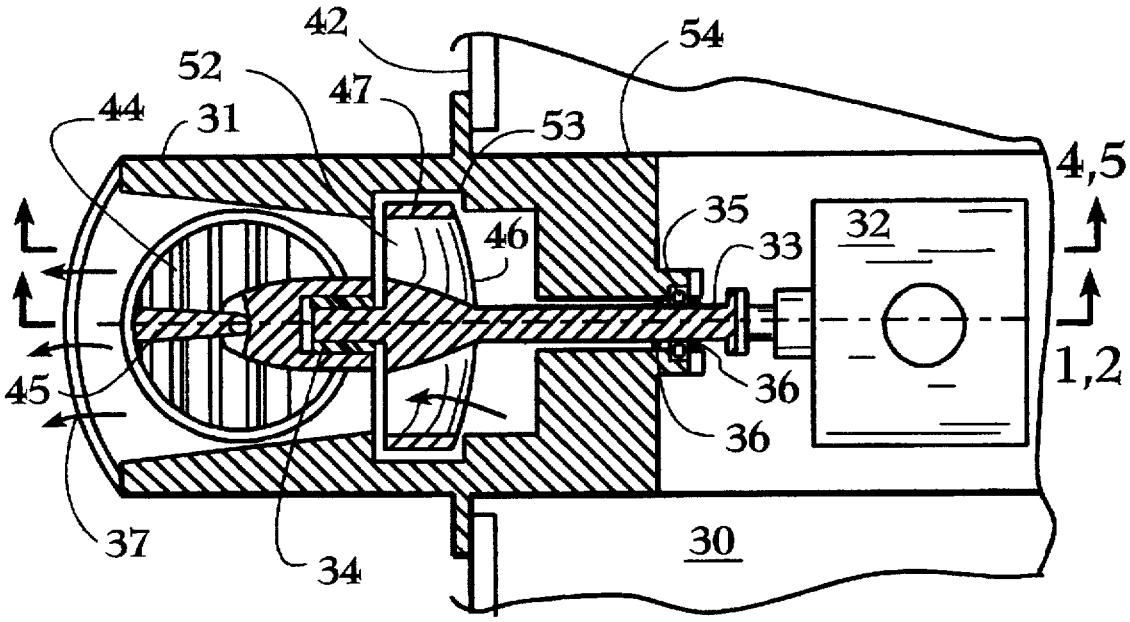
FIG. 3 is a top view centerline cross sectional view, as taken through line 3—3 of FIG. 1, that shows the improved marine propulsor when propelling a marine vehicle forward at high speed.

FIG. 1 is a centerline cross sectional view, as taken through line 1—1 of FIG. 3, that shows the instant improved marine propulsor 31 installed in a marine vehicle 30. Mounting of the marine propulsor 31 is against the transom 42 in this instance. The drive engine 32 supplies rotational power to the drive shaft 33 that is then transmitted to the rotor 46, rotor vanes 52, and optional rotor vane shroud or ring 47. Note that the rotor vane ring 47 is attached near the periphery of the rotor 46 and recessed into a housing recess 53 to reduce hydrodynamic drag. The housing 54 or structure in mechanical communication with same supplies at least a majority of 360 degrees of structure around the periphery of the rotor 46. Since the preferred embodiment of the instant invention has a rotor 46 that is about half in and half out of the water flow, there are sharp spiking stress loads on rotor vanes 52 as they enter the water during each rotation. The optional rotor ring 47 greatly adds to the inherent structural integrity of the rotor 46 and rotor vanes 52. Other items shown that would normally be used that relate to the rotor 46 drive system are thrust bearing 35, shaft seals 33, and water lubricated rubber bearing 34.

In FIG. 1, water flow enters through optional inlet grille bars 43, normally airfoil shaped for minimum resistance, and is directed to about the mid or half elevation part of the rotor 46 by inlet flow directing means 48. Note that the inlet flow directing means can be either a valve and/or a fixed structure. Gas such as ambient air, engine exhaust gas, or the like is supplied to the upper portion of the rotor vanes 52 as shown by gas flow arrows 38 in the preferred embodiment of the instant invention. An optional stator vane 50 can be provided for straightening rotor discharge flow.

Parts of a steering and reversing system shown, for this full ahead condition, are a steering rudder 45, reversing guide vanes or nozzles 44, and reverse gate 49. The reverse gate is up or open in this instance to allow full flow of liquid and gas for maximum ahead thrust. Note that the rudder 45 and reversing guide vanes are a one piece assembly, driven by a common drive means, and have a common rotational axis 55 in this preferred version of the instant invention. A water deflecting device or flap 51 and waterline 39 are also shown.

Figure 2:
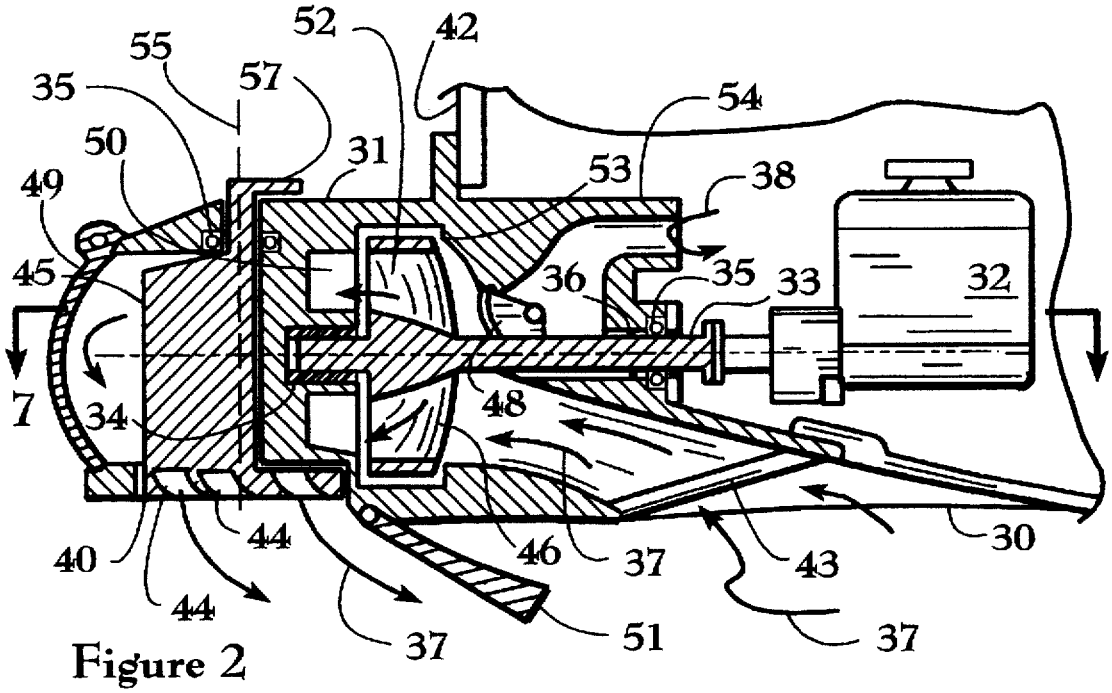
FIG. 2 is a similar centerline cross sectional view, as taken through line 2—2 of FIG. 3, that shows the improved marine propulsor operating in reverse. Note that the liquid flow directing means is closed to eliminate gas flow to the rotor and a reverse flow blocking mechanism has been rotated downward to block flow from exiting aft and thus redirecting flow to a reversing set of guide vanes.

FIG. 2 is the same cross sectional view, as taken through line 2—2 of FIG. 3, as was presented in FIG. 1 but for a reversing condition. The liquid flow control or directing valve 48 is closed in this instance to allow liquids to flow to the upper portion of the rotor vanes 52 since, in the preferred embodiment, the liquid follows the curvilinear shape of the liquid flow directing valve 48. Liquid discharge from the rotor vanes 52 is redirected by the reversing gate 49 to the reversing guide vanes 44 which results in a reverse thrust situation. Note that the optional water deflector 51 is rotated forward by the force of the water discharge in this instance.

FIG. 3 is a cross sectional view, as taken through line 3—3 of FIG. 1, that shows a top or plan view of the improved marine propulsor 31 when operating in a full ahead condition. The rudder 45 has a chopped or truncated aft end in this instance to reduce drag by allowing gas ventilation.

Figure 4:
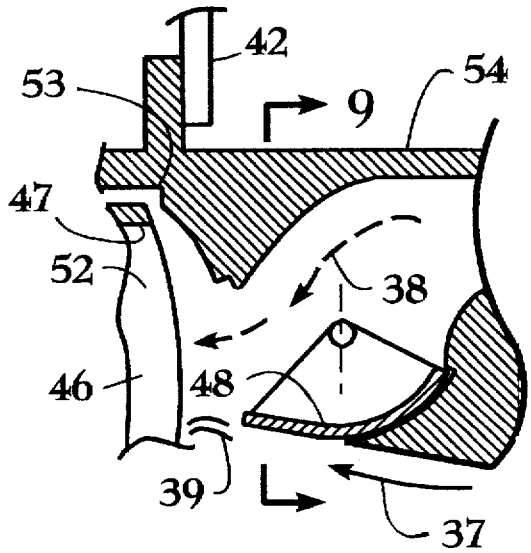
FIG. 4 is a partial cross sectional view, as taken through line 4—4 of FIG. 3, that shows a liquid flow directing valve that directs liquid to the rotor's vanes at a controlled level. Rotation of the liquid flow directing valve allows raising or lowering of the liquid level going to the rotor vanes. Note that gas flow to upper portions of the rotor vanes also passes through the liquid flow directing valve.

FIG. 4 presents an exploded partial cross sectional view, as taken through line 4—4 of FIG. 3, that shows details of the preferred embodiment of the liquid flow directing valve 48. Note that this valve is curvilinear over its forward portions and more planar aft. This is to aid in forming a waterline 39 between the gas flow, as shown by gas flow arrow 38, and the liquid flow, as shown by liquid flow arrow 37, to the rotor vanes 52.

Figure 5:
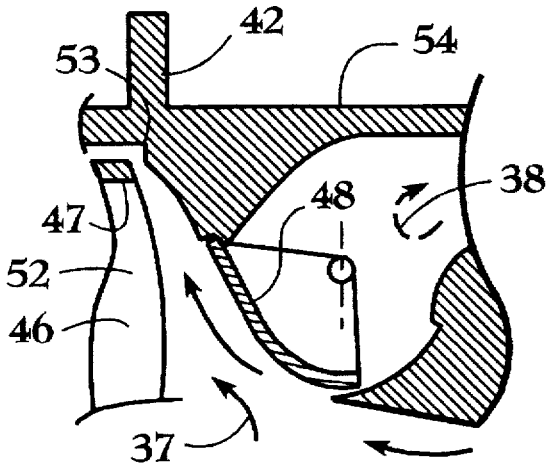
FIG. 5 is another partial cross sectional view, as taken through line 5—5 of FIG. 3, that deplicts the liquid flow directing valve closed so as to substantially eliminate gas flow from the rotor vanes. This condition is used during reversing and, in most instances, low boat speed operation where full rotor flow is desired to obtain maximum thrust.

FIG. 5 shows the same partial cross sectional view, as taken through line 5—5 of FIG. 3, as FIG. 4 but with the liquid flow directing valve closed to restrict gas flow to the rotor vanes 52. This is the condition for reverse and also the preferred condition for operation at low and mid-range marine vehicle speeds. The reason for closing, or partially closing, this liquid flow directing valve 48 at those speeds is that the liquid flow to the rotor vanes 52 is substantially doubled thereby producing greater thrust at the lower speeds. It is important to note that the liquid flow directing valve 48 can be operated at an infinite number of positions to thereby regulate the level of flow to the rotor vanes 52. Also, it is noteworthy that, although not the preferred embodiment of the invention, it is possible to operate with liquid directing valve 48 functioning as shown but with no gas flow to the rotor vanes 52. In such case where the termination of the liquid flow directing valve 48 is very close to the rotor vanes inlet water is still directed to the lower portions of the rotor vanes 52 and a partial vacuum exists over their upper portions. Again, this is not the preferred or most efficient way to operate the instant invention but is possible.

FIG. 6 presents an isometric projection view of the liquid flow directing valve 48 and its optional control lever 56. The reason that it is made in two pieces as shown here is that it straddles the rotor drive shaft.

FIG. 7 is a partial cross sectional view, as taken through line 7—7 of FIG. 2, that shows operation while turning in reverse with the reverse gate 49 down to block reverse flow. Note the curved flow directing shape of the stator vane 50 here.

FIG. 8 is an isometric projection view of the steering and reversing mechanism 40. Note that it is all one piece with a common rotational axis 55 in this variation.

FIG. 9 is a cross sectional view, as taken through line 9—9 of FIG's 1 and 4, that shows the preferred rectangular flow path and housing 54 shape in way of the liquid flow directing valve 48. This partial rectangular shape allows a greater gas flow path and water direction structure width than does a rounded shape here. The configuration shown is for full ahead operation.

While the invention has been described in connection with a preferred and several alternative embodiments, it will be under stood that there is no intention to thereby limit the invention. On the contrary, there is intended to be covered all alternatives, modifications and equivalents as may be included within the spirit and scope of the invention as defined by the appended claims, which are the sole definition of the invention.

What I claim is:

1. In an improved marine propulsor for propelling a marine vehicle with said improved marine propulsor including a rotor having rotor vanes, a liquid flow to said rotor vanes when said rotor is rotating and the improved marine propulsor is propelling the marine vehicle, and said rotor vanes capable of accelerating fluids when said rotor is rotating to thereby provide propulsive thrust, the improvement comprising:

structure enclosing a lower portion of an outer periphery of said rotor vanes over at least a majority of 180 degrees of rotation of said rotor and liquid flow directing means terminating, at least in its majority, less than a distance of one and one half rotor diameters upstream of said rotor vanes wherein said liquid flow is, at least in its majority and when the rotor is rotating and the improved marine propulsor is propelling the marine vehicle forward at high speeds, directed to a lower portion of the rotor vanes and which further comprises a gas flow directed to at least a portion of 180 degrees of said rotor's rotation when said improved marine propulsor is propelling the marine vehicle at high speeds.

2. The improved marine propulsor of claim 1 wherein said liquid flow directing means, at least in its majority, terminates less than a distance of one rotor diameter upstream of said rotor vanes.

3. The improved marine propulsor of claim 1 wherein said liquid flow directing means, at least in its majority, terminates less than a distance of one half rotor diameter upstream of said rotor vanes.

4. The improved marine propulsor of claim 1 wherein said liquid flow directing means is adjustable such that various levels of liquid flow can be directed to the rotor vanes.

5. The improved marine propulsor of claim 1 which further a portion of the liquid flow directing means that is in contact with liquid flow during at least a portion of its operation is curvilinear.

6. The improved marine propulsor of claim 4 wherein said liquid flow directing means is adjustable to a position whereby it shuts off substantially all gas flow to the rotor vanes.

7. The improved marine propulsor of claim 1 which further comprises a steering and reversing mechanism whereby said steering and reversing mechanism has a steering rudder that is commonly driven with a reversing flow steering means and which also comprises a reverse flow blocking means disposed, at least in its majority, aft of said steering rudder.

8. The improved marine propulsor of claim 7 which further comprises a flow deflector disposed, at least in part, below the reversing flow steering means and wherein movement of said flow deflector during reversing is, at least partially, caused by forces supplied by the reversing fluid.

9. The improved marine propulsor of claim 1 which further comprises a rotor ring with said rotor ring, at least during a portion of the rotor's rotation, inset into a housing recess.

10. The improved marine propulsor of claim 1 wherein an internal portion of a housing disposed proximal the liquid flow directing means and upstream of the rotor vanes, as seen in a vertical transverse plane of the marine propulsor, is, at least in part, non-circular in shape.

11. The improved marine propulsor of claim 1 which further comprises a steering and reversing system disposed at least in part downstream of the rotor vanes and whereby during reversing substantially all fluid received by the rotor vanes is liquid.

12. In an improved marine propulsor for propelling a marine vehicle with said improved marine propulsor including a rotor having rotor vanes, a liquid flow to said rotor vanes when said rotor is rotating and the improved marine propulsor is propelling the marine vehicle, and said rotor vanes capable of accelerating fluids when said rotor is rotating to thereby provide propulsive thrust, the improvement comprising:

structure enclosing a lower portion of an outer periphery of said rotor vanes over at least a majority of 180 degrees of rotation of said rotor and a liquid flow directing means disposed, at least in its majority, upstream of said rotor vanes, and a gas flow to an upper portion of said rotor vanes, wherein said liquid flow directing means is capable of varying a level of liquid flow to said rotor vanes and wherein said liquid flow directing means is also capable of stopping substantially all gas flow to an upper portion of said rotor vanes.

13. The improved marine propulsor of claim 12 wherein said liquid flow directing means, at least in its majority, terminates less than a distance of one rotor diameter upstream of said rotor vanes.

14. The improved marine propulsor of claim 12 wherein said liquid flow directing means, at least in its majority, terminates less than a distance of one half rotor diameter upstream of said rotor vanes.

15. The improved marine propulsor of claim 12 wherein at least a portion of the liquid flow directing structure that is in contact with liquid is curvilinear.

16. The improved marine propulsor of claim 12 which further comprises a steering and reversing mechanism whereby said steering and reversing mechanism has a steering rudder that is commonly driven with a reversing flow steering means and which also comprises a reverse flow blocking means disposed, at least in its majority, aft of said steering rudder.

17. The improved marine propulsor of claim 16 which further comprises a flow deflector disposed, at least in part, below the reversing flow steering means and wherein movement of said flow deflector during reversing is, at least partially, caused by forces supplied by the reversing fluid.

18. The improved marine propulsor of claim 12 which further comprises a rotor ring with said rotor ring, at least during a portion of the rotor's rotation, inset into a housing recess.

19. The improved marine propulsor of claim 12 wherein an internal portion of a housing disposed proximal the liquid flow directing means and upstream of the rotor vanes, as seen in a vertical transverse plane of the marine propulsor is, at least in part, non-circular in shape.

20. In an improved marine propulsor for propelling a marine vehicle with said improved marine propulsor including a rotor having rotor vanes, a liquid flow to said rotor vanes when said rotor is rotating and the improved marine propulsor is propelling the marine vehicle, and said rotor vanes capable of accelerating fluids when said rotor is rotating to thereby provide propulsive thrust, the improvement comprising:

a steering and reversing mechanism whereby said steering and reversing mechanism has a forward steering means including a rudder disposed in a liquid discharge flow from said rotor vanes such that said liquid discharge flow is on either side of said rudder and a reversing flow steering means that is commonly driven with and has a common rotational axis with said rudder where said common rotational axis is substantially centered in relation to said reversing flow steering means and a flow blocking means that is connected to a fixed housing of said improved marine propulsor and that operates independent of movement of said forward steering means and is disposed, at least in its majority, aft of said forward steering means and which further comprises a flow deflector connected to the fixed housing of the improved marine propulsor that, when the marine vehicle is moving forward, is capable of deflecting water from contacting a lower portion of the reversing flow steering means and wherein said flow deflector is moveable in relation to the steering and reversing mechanism and is disposed, at least in part, below the reversing flow steering means.

21. The improved marine propulsor of claim 20 wherein the reversing flow steering means has, at least in part, a circular shape.

22. The improved marine propulsor of claim 21 wherein the reversing flow steering means includes a flow guide vane.

23. The improved marine propulsor of claim 21 wherein the reversing flow steering means includes a nozzle.

24. The improved marine propulsor of claim 20 wherein said rudder is truncated at its aft end.

25. The improved marine propulsor of claim 24 which further comprises a stator vane positioned, at least in its majority, forward of and in line with a forward portion of the steering rudder.

26. In an improved marine propulsor for propelling a marine vehicle with said improved marine propulsor including a rotor having rotor vanes, a liquid flow to said rotor vanes when said rotor is rotating and the improved marine propulsor is propelling the marine vehicle, and said rotor vanes capable of accelerating fluids when said rotor is rotating to thereby provide propulsive thrust, the improvement comprising:

liquid and gas flows supplied, to said rotor vanes and wherein liquid flow directing means can substantially separate the liquid and the gas flows to the rotor when said rotor is rotating and the improved marine propulsor is propelling the marine vehicle forward at high speeds, structure enclosing a lower portion of an outer periphery of said rotor vanes over at least a majority of 180 degrees of rotation of said rotor, a steering and reversing mechanism disposed at least in part downstream of the rotor vanes, and whereby during reversing substantially all fluid received by the rotor vanes is liquid.

27. The improved marine propulsor of claim 26 wherein said liquid flow directing means is adjustable during high speed forward operation of said marine vehicle such that various levels of liquid flow can be directed to the rotor vanes.

28. The improved marine propulsor of claim 26 wherein at least a portion of the liquid flow directing means that is in contact with liquid flow during at least a portion of its operation is curvilinear.

29. The improved marine propulsor of claim 26 wherein the steering and reversing mechanism has a steering rudder that is commonly driven and has substantially a common rotational axis with a reversing flow steering means.

30. The improved marine propulsor of claim 26 which further comprises a rotor ring with said rotor ring, at least during a portion of the rotor's rotation, inset into a housing recess.

31. In an improved marine propulsor for propelling a marine vehicle with said improved marine propulsor including a rotor having rotor vanes, a liquid flow to said rotor vanes when said rotor is rotating and the improved marine propulsor is propelling the marine vehicle, and said rotor vanes capable of accelerating fluids when said rotor is rotating to thereby provide propulsive thrust, the improvement comprising:

liquid and gas flows supplied to said rotor vanes and wherein liquid flow directing means can substantially separate the liquid and the gas flows to the rotor when said rotor is rotating and the marine propulsor is propelling the marine vehicle forward at high speeds and structure enclosing a lower portion of an outer periphery of said rotor vanes over at least a majority of 180 degrees of rotation of said rotor.

32. The improved marine propulsor of claim 31 wherein the liquid flow directing means is capable of adjusting a level of liquid flow to said rotor vanes when said rotor is rotating and propelling the marine vehicle forward at high speeds.

33. The improved marine propulsor of claim 31 wherein at least a portion of the liquid flow directing means that is in contact with liquid flow during at least a portion of its operation is curvilinear.

34. The improved marine propulsor of claim 31 wherein said liquid flow directing means terminates, at least in its majority, less than a distance of one and one half rotor diameters upstream of said rotor vanes.

35. The improved marine propulsor of claim 31 wherein said liquid flow directing means terminates, at least in its majority, less than a distance of one rotor diameter upstream of said rotor vanes.

36. The improved marine propulsor of claim 31 wherein said liquid flow directing means terminates, at least in its majority, less than a distance of one half rotor diameter upstream of said rotor vanes.

37. The improved marine propulsor of claim 31 which further comprises a rotor ring with said rotor ring, at least during portion of the rotor's rotation, inset into a housing recess.

38. The improved marine propulsor of claim 31 which further comprises a steering and reversing mechanism disposed, at least in part, downstream of the rotor vanes and whereby during reversing substantially all fluid received by the rotor vanes is liquid.

39. The improved marine propulsor of claim 31 herein an internal portion of a housing disposed proximal the liquid flow directing means and upstream of the rotor vanes, as seen in a vertical transverse plane of the marine propulsor, is, at least in part, non-circular in shape.

* * * * *